United States Patent [19]

Nishijima et al.

[11] Patent Number: 5,049,482

[45] Date of Patent: Sep. 17, 1991

[54] SILVER HALIDE LIGHT-SENSITIVE PHOTOGRAPHIC MATERIAL FORMING A DYE IMAGE OF ENHANCED LIGHT FASTNESS

[75] Inventors: Toyoki Nishijima; Masaki Tanji, both of Odawara, Japan

[73] Assignee: Konica Corporation, Tokyo, Japan

[21] Appl. No.: 400,079

[22] Filed: Aug. 29, 1989

[30] Foreign Application Priority Data

Sep. 1, 1988 [JP] Japan ..... 63-218749

[51] Int. Cl.[5] ..... G03C 1/34

[52] U.S. Cl. ..... 430/551; 430/554; 430/555; 430/607

[58] Field of Search ..... 430/555, 554, 551, 607

[56] References Cited

U.S. PATENT DOCUMENTS

| | | | |
|---|---|---|---|
| 4,254,216 | 3/1981 | Uchida et al. | 430/554 |
| 4,346,165 | 8/1982 | Sawada et al. | 430/551 |
| 4,735,893 | 4/1988 | Morigaki et al. | 430/551 |
| 4,865,963 | 9/1989 | Furutachi et al. | 430/551 |

FOREIGN PATENT DOCUMENTS

| | | | |
|---|---|---|---|
| 2110521 | 9/1971 | Fed. Rep. of Germany . | |
| 0069141 | 5/1980 | Japan | 430/607 |
| 2004078 | 3/1979 | United Kingdom . | |

*Primary Examiner*—Charles L. Bowers, Jr.
*Assistant Examiner*—Lee C. Wright
*Attorney, Agent, or Firm*—Jordan B. Bierman

[57] ABSTRACT

A silver halide photographic light-sensitive material improved in fastness to light of the color image formed thereon. The photographic material comprises a support and a silver halide emulsion layer containing a dye-forming coupler, a compound represented by the following Formula I, and a compound represented by the following Formula II:

(I)

(II)

wherein $R_1$ and $R_2$ each represents a straight or branched chain alkyl group having 1 to 4 carbon atoms or a straight of branched chain alkenyl group having 1 to 4 carbon atoms; $R_5$ and $R_6$ each represents a straight or branched chain alkyl group having 5 to 18 carbon atoms or a straight of branched chain alkenyl group having 5 to 18 carbon atoms; and $R_3$, $R_4$, $R_7$ and $R_8$ each represents a straight or branched chain alkyl group having 4 to 8 carbon atoms.

9 Claims, No Drawings

SILVER HALIDE LIGHT-SENSITIVE PHOTOGRAPHIC MATERIAL FORMING A DYE IMAGE OF ENHANCED LIGHT FASTNESS

FIELD OF THE INVENTION

The present invention relates to a silver halide light-sensitive photographic material, and more particularly to a silver halide light-sensitive photographic material which is capable of forming a dye image excellent in the fastness against light.

BACKGROUND OF THE INVENTION

A prevailing method of forming a dye image by use of a silver halide light-sensitive photographic light-sensitive material is carried out in the manner of forming dyes by the reaction of photographic couplers with the oxidation product of a color developing agent as described in James et al. 'The Theory of Photographic Process' 4th ed., (1977). Those photographic couplers usually used for color reproduction include magenta, yellow and cyan couplers, and useful examples of the color developing agent include aromatic primary amine type color developing agents. The reaction of such magenta and yellow couplers with the oxiation product of an aromatic primary amine-type color developing agent forms dyes such as azomethine dyes, and the reaction of such a cyan coupler with the same oxidation product forms a dye such as an indoaniline dye.

One of the basic characteristics desired for a dye image that is formed by the reaction of such magenta, yellow and cyan couplers with the oxidation product of a color developing agent is to be excellent in the color reproduction without having any useless absorption in its spectral absorption characteristic. Thus, there have hitherto been proposed various types of couplers for improving the color reproducibility. Generally speaking, however, they have the problem that they, if improved on the spectral absorption characteristic, tend to be deteriorated in the fastness against light.

Particularly, a dye image formed from a magenta coupler is poor in the fastness against light and has many useless absorptions in its spectral absorption characteristic, and thus a demand for its improvement have been made.

As the magenta coupler a pyrazolone-type coupler which is relatively satisfactory in the fastness against light is usually used, but still inadequate in the fastness against light as well as in the spectral absorption characteristic. One method for improving both fastness to light and spectral absorption characteristic is a method of optimizing the structure of the magenta coupler.

There are those 1,2-pyrazolo-5-one-type magenta couplers having an anilino group in the third position thereof as described in Japanese Patent Publication Open to Public Inspection (hereinafter referred to as Japanese Patent O.P.I. Publication) No.111631/1974, U.S. Pat. No. 3,519,429, etc., and the use of these magenta couplers are effective to some extent in improving the fastness to light and spectral absorption characteristic, but still not sufficient.

On the other hand, there have been proposed other methods for improving the fastness to light which include a method of protecting a dye image from ultraviolet rays by use of an ultraviolet absorbing agent; a method of preventing a dye image from being faded by light by use of an antifading agent; a method of making a magenta coupler light-resistant by introducing a light-resistance-providing group thereto; and the like.

Of these methods, the method which uses an ultraviolet absorbing agent needs the use of a relatively large amount of the agent in order to provide a satisfactory light fastness to a dye image, and has the drawback that, in this instance, the dye image or its white background is stained because the ultraviolet absorbing agent itself has a color. And, making the dye image fast against light by an ultraviolet absorbing agent has its limits because prevention of the dye image from fading by visible rays cannot be attained by the ultraviolet absorbing agent alone.

Known as the method which uses an antifading agent is a method of using an antifading agent having a phenolic hydroxyl group or a group capable of being hydrolyzed to produce a phenolic hydroxyl group. Those proposed to be used as such the antifading agent include, for example, phenols and bisphenols; pyrogallol and gallic acid and its esters; α-toco-pherols and their acyl derivatives; hydroquinone derivatives; 6-hydroxychromans; 5-hydroxychromans; 6,6'-hydroxy-2,2'-bis-spirochromans; and the like. However, these compounds are not considered to be sufficiently effective in preventing the magenta dye image from fading. Besides, any of these compounds, when added in a large amount to a light-sensitive material to raise its effect, tend to deteriorate the characteristics (to soften the gradation) of the light-sensitive material.

Some of these antifading agents, when used, deteriorate the spectral absorption characteristic of a dye formed.

Accordingly, there has been a demand for developing a method of improving the dye image's fastness against light without deteriorating the photographic characteristic or gradation and the spectral absorption characteristic or half band width of a magenta image of a photographic light-sensitive material.

SUMMARY OF THE INVENTION

It is an object of this invention to provide a silver halide light-sensitive photographic material capable of forming a dye image having an improved light fastness.

It is another object of this invention to provide a high-speed silver halide light-sensitive photographic material capable of forming a high-gradation dye image excellent in the color reproduction as well as in the light fastness.

The above objects of this invention is accomplished by a silver halide light-sensitive photographic material comprising a support having thereon a silver halide emulsion layer containing a dye-forming coupler, a compound represented by the following Formula I and a compound represented by the following Formula II:

Formula I

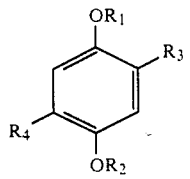

-continued

Formula II

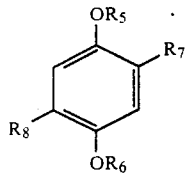

wherein $R_1$ and $R_2$ each represents a straight-chain or branched-chain alkyl or alkenyl group each having from 1 to 4 carbon atoms; $R_5$ and $R_6$ each represents a straight-chain or branched-chain chain alkyl or alkenyl group each having from 5 to 18 carbon atoms; and $R_3$, $R_4$, $R_7$ and $R_8$ each represents a straight-chain or branched-chain alkyl group having from 4 to 8 carbon atoms.

DETAILED DESCRIPTION OF THE INVENTION

Firstly, those compounds having Formula I will be explained.

Formula I

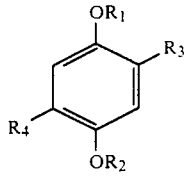

In the formula, $R_1$ and $R_2$ each represents a straight-chain or branched-chain alkyl group having from 1 to 4 carbon atoms, such as methyl, ethyl, n-propyl, i-propyl, n-butyl or t-butyl, or a straight-chain or branched-chain alkenyl group having from 1 to 4 carbon atoms, such as i-propenyl or allyl, preferably a straight-chain or branched-chain alkyl or alkenyl group each having from 3 to 4 carbon atoms, and more preferably an alkyl group having from 3 to 4 carbon atoms.

$R_3$ and $R_4$ each represents a straight-chain or branched-chain alkyl group having from 4 to 8 carbon atoms, such as n-octyl, t-octyl, n-butyl, t-butyl, sec-butyl, n-pentyl, t-pentyl, n-hexyl, sec-hexyl or t-hexyl, and preferably an alkyl having from 4 or 5 carbon atoms.

The following are examples of the compound having Formula I, but those represented by Formula I are not limited to the following exemplified compounds:

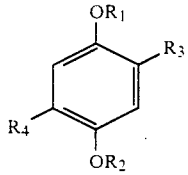

| No. | $R_1$ | $R_2$ | $R_3$ | $R_4$ |
|---|---|---|---|---|
| I-1 | $-C_2H_5$ | $-C_2H_5$ | $-(t)C_8H_{17}$ | $-(t)C_8H_{17}$ |
| I-2 | $-CH_2CH=CH_2$ | $-CH_2CH=CH_2$ | $-(t)C_8H_{17}$ | $-(t)C_8H_{17}$ |
| I-3 | $-(n)C_3H_7$ | $-(n)C_3H_7$ | $-(t)C_8H_{17}$ | $-(t)C_8H_{17}$ |
| I-4 | $-(i)C_3H_7$ | $-(i)C_3H_7$ | $-(t)C_8H_{17}$ | $-(t)C_8H_{17}$ |
| I-5 | $-C(CH_3)=CH_2$ | $-C(CH_3)=CH_2$ | $-(t)C_8H_{17}$ | $-(t)C_8H_{17}$ |
| I-6 | $-C_2H_5$ | $-C_3H_7$ | $-(t)C_8H_{17}$ | $-(t)C_8H_{17}$ |
| I-7 | $-C_2H_5$ | $-C_2H_5$ | $-(n)C_8H_{17}$ | $-(n)C_8H_{17}$ |
| I-8 | $-(n)C_3H_7$ | $-(n)C_3H_7$ | $-(t)C_8H_{17}$ | $-(n)C_8H_{17}$ |
| I-9 | $-(n)C_4H_9$ | $-(n)C_4H_9$ | $-(t)C_8H_{17}$ | $-(t)C_8H_{17}$ |
| I-10 | $-(t)C_4H_9$ | $-(t)C_4H_9$ | $-(t)C_8H_{17}$ | $-(t)C_8H_{17}$ |
| I-11 | $-(n)C_3H_7$ | $-(n)C_3H_7$ | $-CH_2CH(C_2H_5)C_4H_9$ | $-CH_2CH(C_2H_5)C_4H_9$ |
| I-12 | $-(i)C_3H_7$ | $-(i)C_3H_7$ | $-CH_2CH(C_2H_5)C_4H_9$ | $-CH_2CH(C_2H_5)C_4H_9$ |
| I-13 | $-(n)C_4H_9$ | $-(n)C_4H_9$ | $-(t)C_4H_9$ | $-(t)C_4H_9$ |
| I-14 | $-(t)C_4H_9$ | $-(t)C_4H_9$ | $-(t)C_4H_9$ | $-(t)C_4H_9$ |
| I-15 | $-(n)C_4H_9$ | $-(n)C_4H_9$ | $-(t)C_5H_{11}$ | $-(t)C_5H_{11}$ |
| I-16 | $-(t)C_4H_9$ | $-(t)C_4H_9$ | $-(t)C_5H_{11}$ | $-(t)C_5H_{11}$ |
| I-17 | $-C_2H_5$ | $-C_2H_5$ | $-(t)C_4H_9$ | $-(t)C_4H_9$ |
| I-18 | $-CH_2CH=CH_2$ | $-CH_2CH=CH_2$ | $-(t)C_4H_9$ | $-(t)C_4H_9$ |
| I-19 | $-(n)C_3H_7$ | $-(n)C_3H_7$ | $-(t)C_4H_9$ | $-(t)C_4H_9$ |
| I-20 | $-(i)C_3H_7$ | $-(i)C_3H_7$ | $-(t)C_4H_9$ | $-(t)C_4H_9$ |
| I-21 | $-C(CH_3)=CH_2$ | $-C(CH_3)=CH_2$ | $-(t)C_4H_9$ | $-(t)C_4H_9$ |
| I-22 | $-C_2H_5$ | $-(n)C_3H_7$ | $-(t)C_4H_9$ | $-(t)C_4H_9$ |

-continued

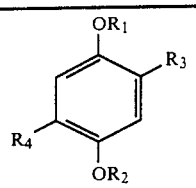

| No. | $R_1$ | $R_2$ | $R_3$ | $R_4$ |
|---|---|---|---|---|
| I-23 | $-C_2H_5$ | $-C_2H_5$ | -(t)$C_5H_{11}$ | -(t)$C_5H_{11}$ |
| I-24 | $-CH_2CH=CH_2$ | $-CH_2CH=CH_2$ | -(t)$C_5H_{11}$ | -(t)$C_5H_{11}$ |
| I-25 | -(n)$C_3H_7$ | -(n)$C_3H_7$ | -(t)$C_5H_{11}$ | -(t)$C_5H_{11}$ |
| I-26 | -(i)$C_3H_7$ | -(i)$C_3H_7$ | -(t)$C_5H_{11}$ | -(t)$C_5H_{11}$ |
| I-27 | $-C(CH_3)=CH_2$ | $-C(CH_3)=CH_2$ | -(t)$C_5H_{11}$ | -(t)$C_5H_{11}$ |
| I-28 | $-C_2H_5$ | $-C_2H_5$ | -sec$C_4H_9$ | -sec$C_4H_9$ |
| I-29 | $-C_2H_5$ | $-C_2H_5$ | -(n)$C_5H_{11}$ | -(n)$C_5H_{11}$ |
| I-30 | -(n)$C_3H_7$ | -(n)$C_3H_7$ | -sec$C_4H_9$ | -(t)$C_4H_9$ |
| I-31 | $-CH_3$ | $-CH_3$ | -(t)$C_5H_{11}$ | -(t)$C_5H_{11}$ |
| I-32 | $-CH_3$ | $-CH_3$ | -(t)$C_4H_9$ | -(t)$C_4H_9$ |

The compound having Formula I of this invention is used usually in an amount of from 0.05 mole to 3 moles, and preferably from 0.5 mole to 2 moles per mole of a coupler to be used with the compound in an emulsion layer.

Subsequently, those compounds having Formula II will be explained:

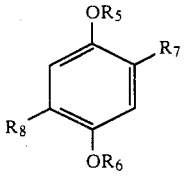

Formula II

In the formula, $R_5$ and $R_6$ each represents a straight-chain or branched-chain alkyl group having from 5 to 18 carbon atoms, such as n-pentyl, t-amyl, n-hexyl, 2-ethyl-hexyl, n-octyl, n-nonyl, i-nonyl, n-decyl, i-decyl, n-dodecyl or n-stearyl, or a straight-chain or branched-chain alkenyl group having from 5 to 18 carbon atoms, such as stearenyl; and $R_7$ and $R_8$ each represents the same groups as those defined in the $R_3$ and $R_4$ of Formula I.

The following are examples of the compound having Formula II, but those represented by Formula II are not limited to the following exemplified compounds:

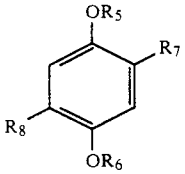

| No. | $R_5$ | $R_6$ | $R_7$ | $R_8$ |
|---|---|---|---|---|
| II-1 | -(t)$C_5H_{11}$ | -(t)$C_5H_{11}$ | -(t)$C_5H_{11}$ | -(t)$C_5H_{11}$ |
| II-2 | -(n)$C_6H_{13}$ | -(n)$C_6H_{13}$ | -(t)$C_5H_{11}$ | -(t)$C_5H_{11}$ |
| II-3 | -(n)$C_8H_{17}$ | -(n)$C_8H_{17}$ | -(t)$C_5H_{11}$ | -(t)$C_5H_{11}$ |
| II-4 | $-CH_2CH(C_2H_5)C_2H_5$ | $-CH_2CH(C_2H_5)C_2H_5$ | -(t)$C_5H_{11}$ | -(t)$C_5H_{11}$ |
| II-5 | -(t)$C_8H_{17}$ | -(t)$C_8H_{17}$ | -(t)$C_5H_{11}$ | -(t)$C_5H_{11}$ |
| II-6 | -(n)$C_{12}H_{25}$ | -(n)$C_{12}H_{25}$ | -(t)$C_5H_{11}$ | -(t)$C_5H_{11}$ |
| II-7 | -(n)$C_{18}H_{37}$ | -(n)$C_{18}H_{37}$ | -(t)$C_5H_{11}$ | -(t)$C_5H_{11}$ |
| II-8 | $-CH=CHC_{16}H_{33}$ | $-CH=CHC_{16}H_{33}$ | -(t)$C_5H_{11}$ | -(t)$C_5H_{11}$ |
| No. | $R_5$ | $R_6$ | $R_7$ | $R_8$ $R_4$ |
| II-9 | -(n)$C_5H_{17}$ | -(n)$C_8H_{17}$ | -(t)$C_5H_{11}$ | -(t)$C_5H_{11}$ |
| II-10 | -(t)$C_5H_{11}$ | -(t)$C_5H_{11}$ | -(t)$C_8H_{17}$ | -(t)$C_8H_{17}$ |
| II-11 | -(n)$C_6H_{13}$ | -(n)$C_6H_{13}$ | -(t)$C_8H_{17}$ | -(t)$C_8H_{17}$ |
| II-12 | -(n)$C_8H_{17}$ | -(n)$C_8H_{17}$ | -(t)$C_8H_{17}$ | -(t)$C_8H_{17}$ |
| II-13 | -(n)$C_{12}H_{25}$ | -(n)$C_{12}H_{25}$ | -(t)$C_8H_{17}$ | -(t)$C_8H_{17}$ |
| II-14 | -(n)$C_{18}H_{37}$ | -(n)$C_{18}H_{37}$ | -(t)$C_8H_{17}$ | -(t)$C_8H_{17}$ |
| II-15 | $-CH=CHC_{16}H_{33}$ | $-CH=CHC_{16}H_{33}$ | -(t)$C_8H_{17}$ | -(t)$C_8H_{17}$ |
| II-16 | -(n)$C_8H_{17}$ | -(n)$C_8H_{17}$ | -(t)$C_4H_9$ | -(t)$C_4H_9$ |
| II-17 | -(n)$C_{12}H_{25}$ | -(n)$C_{12}H_{25}$ | -(t)$C_4H_9$ | -(t)$C_4H_9$ |
| II-18 | -(n)$C_8H_{17}$ | -(n)$C_8H_{17}$ | -(n)$C_5H_{11}$ | -(n)$C_5H_{11}$ |

The compound having Formula II of this invention is used usually in an amount of from 0.05 mole to 2 moles, and preferably from 0.05 mole to 0.5 mole per mole of a coupler to be used with the compound in an emulsion layer.

As the magenta dye forming coupler usable in the silver halide light-sensitive photographic material of this invention those couplers as disclosed in, e.g., U.S. Pat. Nos. 3,684,514 and 3,519,429, and Japanese Patent O.P.I. Publication No. 111631/1974, may be suitably used. Particularly, the use of any of those couplers having the following Formula M may be advantageous.

Formula M

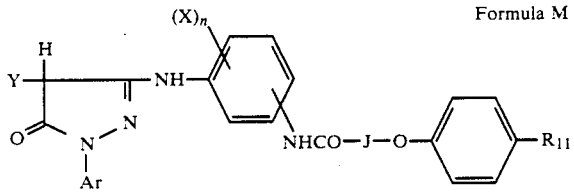

wherein Ar represents an aryl group; Y represents a hydrogen atom or a group capable of splitting off upon the reaction with the oxidation product of a color developing agent; X is a halogen atom, an alkoxy group or an alkyl group; $R_{11}$ is a straight-chain or branched-chain alkyl group having from 1 to 20 carbon atoms; J is a straight-chain or branched-chain alkylene group: and n is an integer of zero to 4, provided that when n is 2 or more, the Xs may be either the same or different.

In Formula M, the Ar represents an aryl group, and preferably a phenyl group having a substituent. The substituent is preferably a halogen atom such as fluorine, chlorine or bromine; an alkyl group such as methyl, ethyl or butyl; an alkoxy group such as methoxy or ethoxy; an aryloxy group such as phenoxy or naphthoxy; an acylamino group such as α-(2,4-di-t-amylphenoxy)-butylamido or benzamido; a sulfonylamino group such as hexadecansulfonamido or benzenesulfonamido; a sulfamoyl group such as methylsulfamoyl or phenylsulfamoyl: a carbamoyl group such as butylcarbamoyl or phenylcarbamoyl a sulfonyl group such as methylsulfonyl, dodecylsulfonyl or benzenesulfonyl; an acyloxy group; an ester group; a carboxyl group; a sulfo group; a cyano group; a nitro group; or the like.

The group represented by Y capable of splitting off upon the reaction with the oxidation product of a color developing agent is a halogen atom such as chlorine, bromine, fluorine; or a group such as alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocylic thio, alkyloxythio, carbonylthio, acylamino, sulfonamido, nitrogen-containing heterocyclic ring linked with a nitrogen atom, alkyloxycarbonylamino, aryloxycarbonylamino, or the like group.

The X is a halogen atom such as chlorine, bromine or fluorine; an alkoxy group such as methoxy, ethoxy or butoxy; or an alkyl group such as methyl, ethyl, isopropyl, n-butyl or n-hexyl. And the n represents an integer of zero to 4. Provided, however, that when the n is 2 or more, the Xs may be either the same of different.

The $R_{11}$ is a straight-chain or branched-chain alkyl group having from 1 to 20 carbon atoms, such as methyl, t-butyl, t-amyl, t-octyl, nonyl or dodecyl.

The J is a straight-chain or branched-chain alkylene group which is preferably a methylene group which may have an alkyl substituent or a trimethylene group which may have an alkyl substituent; more preferably a methylene group; particularly preferably a methylene group having an alkyl substituent having from 1 to 20 carbon atoms, such as n-hexyl-methylene, n-octyl-methylene or n-dodecyl-methylene; and most preferably a methylene group having an alkyl substituent having from 1 to 4 carbon atoms, such as methyl-methylene, ethyl-methylene, n-propyl-methylene, i-propyl-methylene or n-butyl-methylene.

Examples of the above-mentioned magenta coupler are described in Japanese Patent Application No. 139453/1988.

As the yellow dye forming coupler, acylacetanilide-type couplers may be suitably used. Of these couplers, benzoylacet-anilide-type and pivaloylacetanilide-type compounds are advantageous.

Useful examples of the yellow coupler are those as disclosed in British Patent No. 1,077,874, Japanese Patent Examined Publication No. 40757/1970, Japanese Patent O.P.I. Publication Nos. 1031/1972, 26133/1972, 94432/1973, 87650/1975, 3631/1976, 11517219/1977, 99433/1979, 133329/1979 and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,021,259, 4,022,620, 4,029,508, 4,057,432, 4,106,942, 4,133,958, 4,269,936. 4,286,053, 4,304,845, 4,314,023, 4,336,327, 4,356,258, 4,386,155 and 4,401,752.

As the cyan dye forming coupler, phenol-type and naphthol-type cyan dye forming couplers may be used.

These cyan dye forming couplers are those as described in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patent Nos. 478,991, 945,542, 1,084,480, 1,337,233, 1,388,244 and 1,543,040, Japanese Patent O.P.I. Publication Nos. 37425/1972, 10135/1975, 25228/1975, 112038/1075, 117422/1975, 130441/1975, 6551/1976, 37647/1976, 52528/1976, 108841/1976, 109630/1978, 48237/1979, 66129/1979, 131931/1979, 32071/1980, 146050/1984, 31953/1984 and 117249/1985.

Those dye forming couplers for this invention may be used in appropriate emulsion layers in the amount range of from $1\times10^{-3}$ mole to 1 mole and preferably from $1\times10^{-2}$ mole to $8\times10^{-1}$ mole per mole of silver halide.

Any of the above-mentioned dye forming couplers may be dissolved into a high-boiling organic solvent having a boiling point of not less than 150° C., or, if necessary, into a mixture of it with a low-boiling solvent and/or a water-soluble organic solvent, and the solution is then emulsifiedly dispersed by using a surface active agent into a hydrophilic binder such as an aqueous gelatin solution, and after that the dispersed liquid is incorporated into an objective hydrophilic colloid layer. Into the above process may be inserted a step to remove the low-boiling solvent from the dispersed liquid or at the time of the dispersing.

The high-boiling solvent used in this invention is preferably a compound having a dielectric constant of not more than 6, examples of which include esters such as phthalates, phosphates. etc. organic amides, ketones and hydrocarbon compounds, each having a dielectric constant of not more than 6; and more preferably a high-boiling organic solvent having a dielectric constant of from 1.9 to 6 and a vapor pressure of not more than 0.5 mmHg at 100° C. More preferred among these high-boiling organic solvents are phthalates or phosphates, and the most preferred are dialkyl phthalates having alkyl groups whose number of carbon atoms are not less than 9.

Further, the high-boiling organic solvent may be a mixture of two or more different types thereof.

Incidentally, the above-mentioned dielectric constant means a dielectric constant at 30° C.

Any of these high-boiling organic solvents may be used in the amount range of from zero to 400 % by weight, and preferably from 10 to 100 % by weight of the weight of a coupler to be used.

The silver halide light-sensitive photographic material used in this invention may be, e.g., a color negative film or a positive film for use in making prints therefrom, or a color photographic paper, and it well exhibits the effect of this invention particularly when used as a color photographic paper for direct appreciation.

The silver halide light-sensitive photographic material of this invention, which is used as a color photographic paper or as other photographic films, may be for either monochromatic or multicolor photography use. Where it is a silver halide light-sensitive photographic material for multicolor use, in order to carry out subtractive color reproduction, it is of a structure comprising a support having thereon silver halide emulsion layers containing photographic couplers such as magenta, yellow and cyan couplers, and non-light-sensitive layers, which all layers are in the form of an arbitrary number of multilayers coated in an arbitrary order from the support side. The number and order of the layers to be formed on the support are allowed to be discretionally altered according to the purpose for which the light-sensitive material is used.

In the case where the silver halide light-sensitive photographic material of this invention is a multicolor light-sensitive material, its particularly desirable layer construction is one that comprises a support having thereon, in order from the support side, a yellow dye image forming layer, an intermediate layer, a magenta dye image forming layer, an intermediate layer, a cyan dye image forming layer, an intermediate layer, and a protective layer.

As the binder or protective colloid used for the silver halide light-sensitive photographic material of this invention. gelatin may be advantageously used. Besides, a gelatin derivative, a graft polymer produced from gelatin and other high polymer compound, a protein, a sugar derivative, a cellulose derivative, and a hydrophilic colloid like a synthetic hydrophilic high molecular material such as a homo- or copolymer may also be used.

The photographic emulsion layers and other hydrophilic colloid layers of the silver halide light-sensitive photographic material of this invention may be hardened by using a single hardener or different-type hardeners in combination capable of cross-linking the binder or protective colloid's molecules to strengthen the layers' hardness. The hardener is preferably added in an amount enough to harden the light-sensitive material so as not required to be added to the processing solution, but it is also possible to add the hardener to the solution.

The hydrophilic colloid layers, such as a protective layer, an intermediate layer, of the silver halide light-sensitive material of this invention may contain an ultraviolet absorbing agent in order to prevent the light-sensitive material from being fogged by discharge of the triboelectric charge in the light-sensitive material and also to prevent its resulting dye image from being deteriorated by ultraviolet rays.

The silver halide light-sensitive photographic material of this invention may have auxiliary layers including filter layers, antihalation layer and/or antiirradiation layer, etc. These layers and/or emulsion layers may contain a dye that is capable of being bleached or dissolved out of the light-sensitive material during its developing process.

A matting agent may be incorporated into the silver halide emulsion layers and/or other hydrophilic colloid layers of the light-sensitive material of this invention in order to lower the Surface glossiness of the light-sensitive material to increase its retouchability and also to prevent the light-sensitive material from adhering to each other.

A lubricant may be added to the light-sensitive material of this invention in order to reduce its sliding friction.

An antistatic agent may be added to the light-sensitive material of this invention for the purpose of preventing the light-sensitive material from being charged with static electricity. The antistatic agent may be used either in the antistatic layer on the non-emulsion side of the support or on the surface of the emulsion layer and/or on the surface of the topmost protective layer other than the emulsion layer on the emulsion side of the support of the light-sensitive material.

Various kinds of surface active agent may be used for preparation of the photographic emulsion layers and/or other hydrophilic colloid layers of the light-sensitive material of this invention for the purpose of improving their coatability, antistaticity, slidability, dispersibility, adherence and photographic characteristics such as development-acceleration, contrast raising, sensitization, and the like.

The photographic emulsion layers and other layers of the light-sensitive material of this invention may be coated on an elastic reflection support such as an α-olefin polymer-laminated paper, a baryta paper or synthetic paper, a film support made of a semi-synthetic or synthetic high-molecular material such as cellulose acetate, cellulose nitrate, polystyrene, polyvinyl chloride, polyethylene terephthalate, polycarbonate, polyamide or the like, or a rigid support made of glass, metal, pottery, or the like.

The component layers of the light-sensitive material of this invention may be coated directly on a support or indirectly through one or more subbing layers for improving the adherence, antistaticity, dimensional stability, friction resistance, hardness, antihalation characteristic, friction characteristic and/or other characteristics of a support, on a support whose surface, if necessary, is subjected to corona discharge treatment. ultraviolet irradiation, flame treatment or the like.

In coating the layers of the light-sensitive material of this invention, a viscosity increasing agent may be used in order to improve their coatability. For the coating, the extrusion coating or curtain coating method, capable of coating two or more layers simultaneously, is particularly useful.

The color developing agent to be used in a color developer solution applicable for processing the light-sensitive material of the invention includes those known agents extensively used in various color photographic processes.

The light-sensitive material of the invention, upon completion of its color developing, is processed in a desilverizing ability-having processing solution. This solution is allowed to be a processing solution which also have a fixability, the so-called bleach-fix solution.

As a bleaching agent for use in the bleach-fix process a metallic complex salt of an organic acid is used.

EXAMPLE 1

A paper support one side of which is laminated with polyethylene and the other side of which is laminated with polyethylene containing titanium oxide was used, and on the titanium oxide-containing polyethylene-laminated side were coated the following layers of the compositions shown in Table 1, whereby a multilayer silver halide light-sensitive color photographic material Sample 1 was prepared. The coating liquids were prepared as follows:

Coating liquid for Layer 3

Thirty five grams of a magenta coupler M-A and 1.0 g of an antistain agent HQ-1 were dissolved into 30 g of a high-boiling organic solvent (DNP) and 60 ml of ethyl acetate, and the solution was emulsifiedly dispersed by means of a ultrasonic homogenizer into 200 ml of an aqueous 10% gelatin solution, whereby a magenta coupler dispersion was prepared.

The dispersion was mixed with a green-sensitive silver halide emulsion containing 27 g of silver that was prepared under the following conditions to thereby prepare a coating liquid for Layer 3.

Coating liquids for other layers were also prepared in similar manner to the above Layer 3 coating liquid. To the magenta coupler-dispersion liquid were added antifading agents compound I and compound II in the combinations specified in Table 2 to thereby prepare samples 2 to 21. The following compounds H-1 and H-2 were used as hardening agents:

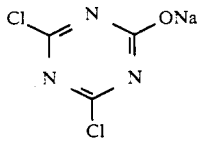

H-1

$C(CH_2SO_2CH{=}CH_2)_4$ H-2

Preparation of a Blue-Sensitive Silver Halide Emulsion Layer

To 1000 ml of an aqueous 2 % gelatin solution kept at 40° C. were added spending 30 minutes the following Solution A and Solution B simultaneously with pAg and pH being controlled to 6.5% and 3.0, respectively, and further were added spending 180 minutes the following solution C and solution D simultaneously with pAg and pH being controlled to 7.5 and 5.5, respectively. In this instance, the control of pAg took place in accordance with the method described in Japanese Patent O.P.I. Publication No. 45437/1984, while the control of pH was made by using sulfuric acid or an aqueous sodium hydroxide solution.

| Solution A: | |
|---|---|
| NaCl | 3.42 g |
| KBr | 0.03 g |
| Water to make | 200 ml |

-continued

| Solution B: | |
|---|---|
| $AgNO_3$ | 10 g |
| Water to make | 200 ml |
| **Solution C:** | |
| NaCl | 102.7 g |
| KBr | 1.0 g |
| Water to make | 600 ml |
| **Solution D:** | |
| $AgNO_3$ | 300 g |
| Water to make | 600 ml |

After adding the above solutions, an aqueous 5% solution of Demol N, producted by Kawo Atlas Co., and an Aqueous 20% magnesium sulfate were used to desalt the emulsion, and the emulsion was then mixed with an aqueous gelatin solution, whereby a monodisperse cubic-grained emulsion EMP-1, having an average grain diameter of 0.85 μm, a coefficient of variation (a/r) of 0.07 and a silver chloride content of 99.5 mole%, was obtained.

The above emulsion EM-1 was chemically ripened for 90 minutes at 50° C. with use of the following compounds, whereby a blue-sensitive silver halide emulsion Em A was obtained.

| | |
|---|---|
| Sodium thiosulfate | 0.8 mg per mole of AgX |
| Chloroauric acid | 0.5 mg per mole of AgX |
| Stabilizer SB-5 | $6 \times 10^{-4}$ mole per mole of AgX |
| Sensitizing dye D-1 | $5 \times 10^{-4}$ mole per mole of AgX |

Preparation of a green-sensitive silver halide emulsion

A monodisperse cubic-grained emulsion EMP-2, having an average grain diameter of 0.43μm, a coefficient of variation (a/r) of 0.08 and a silver chloride content of 99.% mole%, was obtained in the same manner as in EMP-1 except that the time spent for adding solutions A and B and the time spent for adding solutions C and D were changed.

The emulsion EMP-2 was chemically ripened for 120 minutes at 55° C. with use of the following compounds, whereby a green-sensitive silver halide emulsion Em B was obtained.

| | |
|---|---|
| Sodium thiosulfate | 1.5 mg per mole of AgX |
| Chloroauric acid | 1.0 mg per mole of AgX |
| Stabilizer SB-5 | $6 \times 10^{-4}$ mole per mole of AgX |
| Sensitizing dye D-2 | $4.0 \times 10^{-4}$ mole per mole of AgX |

Preparation of a red-sensitive silver halide emulsion

A monodisperse cubic-grained emulsion EMP-3, having an average grain diameter of 0.50 μm, a coefficient of variation (a/r) of 0.08 and a silver chloride content of 99.5 mole%. was obtained in the same manner as in EMP-1 except that the time spent for adding solutions A and B and the time spent for adding solutions C and D were changed.

The emulsion EMP-3 was chemically ripened for 90 minutes at 60° C. with use of the following compounds, whereby a red-sensitive silver halide emulsion Em C was obtained.

| | |
|---|---|
| Sodium thiosulfate | 1.8 mg per mole of AgX |
| Chloroauric acid | 2.0 mg per mole of AgX |
| Stabilizer SB-5 | $6 \times 10^{-4}$ mole per mole of AgX |

-continued

| | |
|---|---|
| Sensitizing dye D-3 | $8.0 \times 10^{-5}$ mole per mole of AgX |

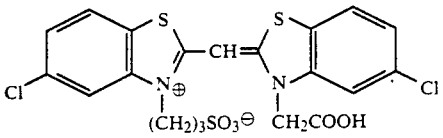

D-1

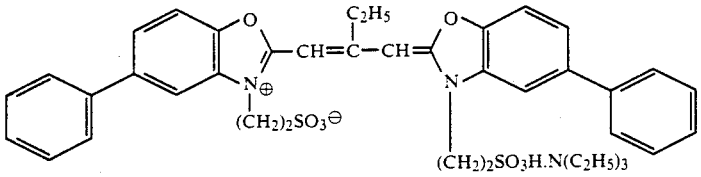

D-2

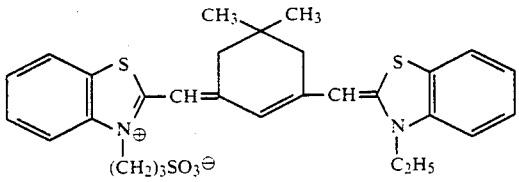

D-3

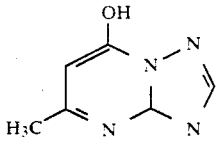

SB-5

TABLE 1

| Layer | Construction | Added amt. ($g/m^2$) |
|---|---|---|
| Layer 7 (Protective layer) | Gelatin | 1.0 |
| Layer 6 | Gelatin | 0.6 |
| | Anti-color-mixing agent HQ-1 | 0.01 |
| | DNP | 0.2 |
| | PVP | 0.03 |
| | Antiirradiation dye AI-2 | 0.02 |
| | Ultraviolet absorbing agent UV-1 | 0.2 |
| | Ultraviolet absorbing agent UV-2 | 0.1 |
| Layer (Red-sensitive layer) | Gelatin | 1.40 |
| | Red-sensitive silver halide emulsion Em C, silver equivalent | 0.24 |
| | Cyan coupler C-1 | 0.17 |
| | Cyan coupler C-2 | 0.25 |
| | Dye image stabilizer ST-1 | 0.20 |
| | High-boiling organic solvent HB-1 | 0.10 |
| | Antistain agent HQ-1 | 0.01 |
| | DOP | 0.30 |
| Layer 4 | Gelatin | 1.30 |
| | Anti-color-mixing agent HQ-1 | 0.03 |
| | DNP | 0.40 |

TABLE 1-continued

| Layer | Construction | Added amt. ($g/m^2$) |
|---|---|---|
| | Ultraviolet absorbing agent UV-1 | 0.6 |
| | Ultraviolet absorbing agent UV-2 | 0.2 |
| Layer 3 (Green-sensitive layer) | Gelatin | 1.40 |
| | Green-sensitive silver halide emulsion Em B, silver equivalent | 0.27 |
| | Magenta coupler M-A | 0.35 |
| | Antistain agent HQ-1 | 0.01 |
| | DNP | 0.30 |
| | Antiirradiation agent AI-1 | 0.01 |
| Layer 2 (Intermediate layer) | Gelatin | 1.20 |
| | Anti-color-mixing agent HQ-1 | 0.12 |
| | Diaminostilbene-type brightening agent | 0.10 |
| | DIDP | 0.15 |
| Layer 1 (Blue-sensitive layer) | Gelatin | 1.30 |
| | Blue-sensitive silver halide emulsion Em A, silver equivalent | 0.30 |
| | Yellow coupler Y-1 | 0.80 |
| | Dye image stabilizer ST-1 | 0.30 |
| | Dye image stabilizer ST-2 | 0.20 |
| | Antistain agent HQ-1 | 0.02 |
| | DNP | 0.20 |
| Support | Polyethylene-laminated paper | |

In the above table, the same substance HQ-1 is called by two names: 'anti-color-mixing agent' and 'antistaining agent', in accordance with its roles in the photographic material.

Y-1

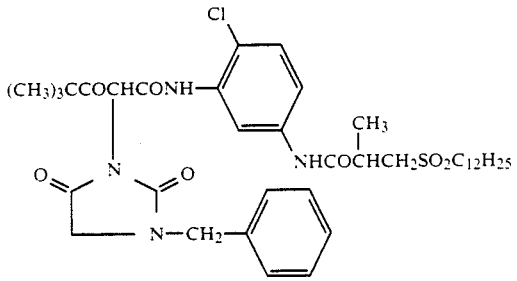

-continued
M-A
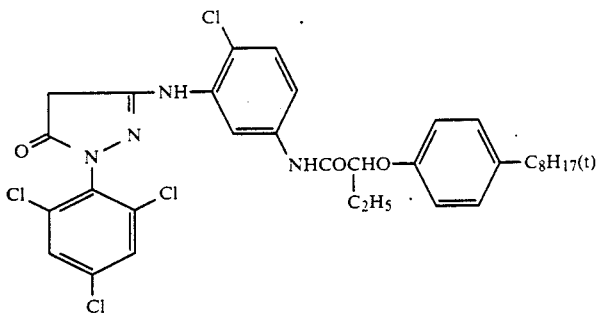
C-1
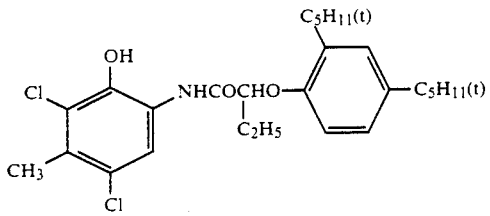
C-2
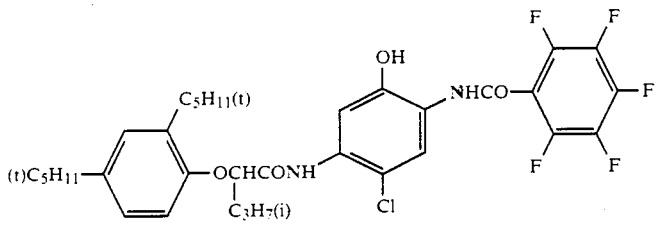
ST-1
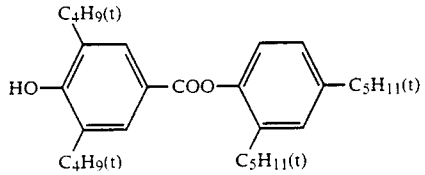
ST-2
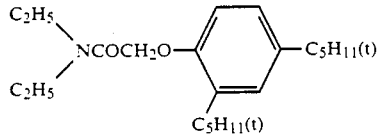
DOP: Dioctyl phthalate
DNP: Dinonyl phthalate
DIDP: Diisodecyl phthalate
PVP: Polyvinyl pyrrolidone
HQ-1
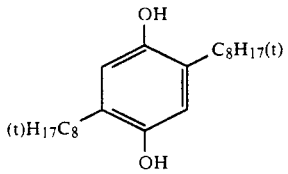
UV-1
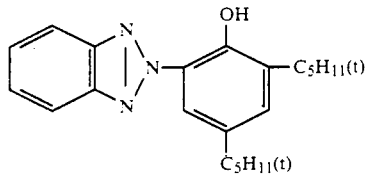

-continued

UV-2

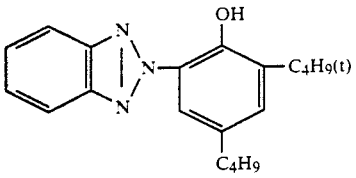

AI-1

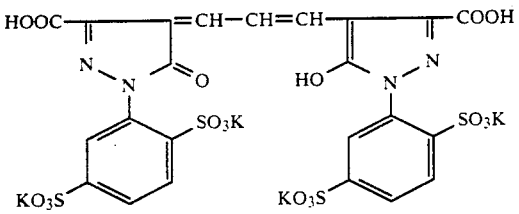

AI-2

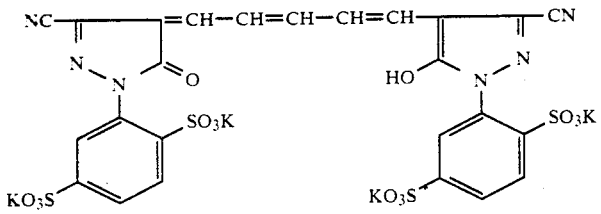

HB-1

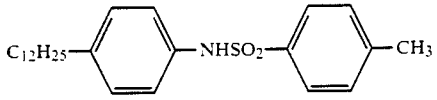

Each sample was exposed through an optical wedge to a green light by means of a Sensitometer KS-7, manufactured by KNOICA Corporation, and then processed in accordance with the following steps:

| Processing steps | Temperature | Time |
|---|---|---|
| Color developing | 35.0 ± 0.3° C. | 45 seconds |
| Bleach-fix | 35.0 ± 0.5° C. | 45 seconds |
| Stabilizing | 30–34° C. | 90 seconds |
| Drying | 60–80° C. | 60 seconds |

| Color developer | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Brightening agent 4,4'-diaminostilbene-disulfonic acid derivative | 1.0 g |
| Potassium carbonate | 27 g |
| Water to make 1 liter. Adjust the pH to 10.10. | |
| **Bleach-fix bath** | |
| Ferric-ammonium ethylenediaminetetraacetate, dihydrated | 60 g |
| Ethylenediaminetetraacetic acid | 3 g |
| Ammonium thiosulfate (aqueous 70% solution) | 100 ml |
| Ammonium sulfite (aqueous 40% solution) | 27.5 ml |
| Water to make 1 liter. Adjust the pH to 5.7 with potassium carbonate or glacial acetic acid. | |
| **Stabilizing bath** | |
| 5-Chloro-2-methyl-4-isothiazolin-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (aqueous 20% solution) | 3.0 g |
| Ammonium sulfite | 3.0 g |
| Brightening agent 4,4'-diaminostilbene-diphosphonic acid derivative | 1.5 g |
| Water to make 1 liter. Adjust the pH to 7.0 with sulfuric acid or potassium hydroxide. | |

Each sample was processed in an automatic processor of which the stabilization process is of a multistage counter flow system.

After the processing, the light resistance and spectral absorption characteristic of each sample were examined as follows:

Light resistance test

An under-glass exposure stand was used to expose each sample to the sunlight over a period of 30 days, and after that, the reflection densities of the sample for a green light before and after the exposure were measured. A fading rate of the sample by light was found from the following formula:

$$\text{Fading rate} = \frac{D - Do}{Do} \times 100$$

wherein

Do = density prior to exposure, and

D = density after exposure.

Measurement of spectral absorption characteristic

The spectral characteristic of the obtained magenta dye image was measured by means of a color analyzer 607, manufactured by Hitach, Ltd. In this instance, a half value width when the reflection density of the magenta dye image at the maximum absorption wavelength (λmax) is 1.0 was measured.

Evaluation of gradation

The gradation (γ) between the reflection densities 0.3 and 0.8 of each Sample was measured.

The results are shown in Table 2.

TABLE 2

| Sample No. | Compound I | Compound II | Fastness fading rate (%) | Spectral absorption characteristic half value width (nm) | Gradation γ |
|---|---|---|---|---|---|
| 1 (comp.) | — | — | −50 | 118 | 3.15 |
| 2 (comp.) | I-31 | — | −18 | 118 | 3.03 |
| 3 (comp.) | — | II-1 | −21 | 118 | 3.11 |
| 4 (inv.) | I-31 | II-1 | −10 | 116 | 3.15 |
| 5 (inv.) | I-31 | II-3 | −11 | 116 | 3.17 |
| 6 (inv.) | I-31 | II-8 | −10 | 116 | 3.15 |
| 7 (inv.) | I-31 | II-10 | −11 | 116 | 3.16 |
| 8 (inv.) | I-31 | II-12 | −11 | 116 | 3.17 |
| 9 (inv.) | I-31 | II-16 | −10 | 116 | 3.17 |
| 10 (inv.) | I-13 | II-3 | −8 | 116 | 3.16 |
| 11 (inv.) | I-15 | II-3 | −9 | 116 | 3.17 |
| 12 (inv.) | I-17 | II-3 | −8 | 116 | 3.16 |
| 13 (inv.) | I-20 | II-3 | −7 | 116 | 3.20 |
| 14 (inv.) | I-23 | II-3 | −8 | 116 | 3.16 |
| 15 (inv.) | I-32 | II-3 | −9 | 116 | 3.16 |
| 16 (comp.) | ST-1 | — | −46 | 118 | 1.85 |
| 17 (comp.) | ST-1 | II-1 | −28 | 118 | 1.96 |
| 18 (comp.) | ST-2 | — | −26 | 121 | 3.13 |
| 19 (comp.) | ST-2 | II-1 | −18 | 120 | 3.14 |
| 20 (comp.) | ST-3 | II-1 | −20 | 120 | 3.13 |
| 21 (comp.) | ST-4 | II-1 | −23 | 117 | 3.01 |

*Compound I: 1.5 moles per mole of coupler.
Compound II: 0.5 mole per mole of coupler.

ST-1

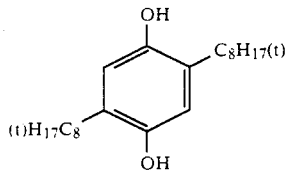

ST-2

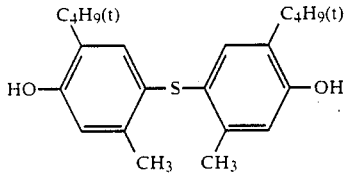

ST-3

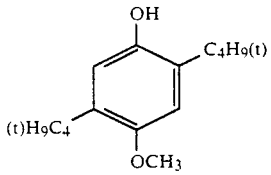

ST-4

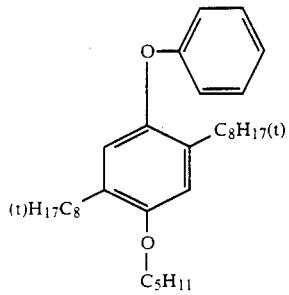

Samples 4 to 15 of this invention each formed a magenta dye image having a particularly strong light fastness. The image was very clear because its absorption spectrum's half value width was not widened nor was its gradation deteriorated.

EXAMPLE 2

On a paper support whose both sides were coated with polyethylene were provided layers 1 through 12 to prepare a color reversal light-sensitive material sample 22. The coated amounts of the components of the layers are indicated in g/m² except that of the silver halide indicated in a silver equivalent.

| | |
|---|---|
| Layer 1 (gelatin layer) | |
| Gelatin | 1.40 |
| Layer 2 (antihalation layer) | |
| Black colloidal silver | 0.10 |
| Gelatin | 0.60 |
| Layer 3 (first red-sensitive layer) | |
| Cyan coupler C-2 | 0.14 |
| Cyan coupler C-1 | 0.07 |
| High-boiling solvent DBP | 0.06 |
| AgBrI emulsion spectrally sensitized by red-sensitizing dyes S-1 and S-2 (AgI 3.0 mole %, average grain diameter 0.4 μm) | 0.14 |
| Gelatin | 1.0 |
| Layer 4 (second red-sensitive layer) | |
| Cyan coupler C-2 | 0.20 |
| Cyan coupler C-1 | 0.10 |
| High-boiling solvent DBP | 0.10 |
| AgBrI emulsion spectrally sensitized by red-sensitizing dyes S-1 and S-2 (AgI 3.0 mole %, average grain diameter 0.8 μm) | 0.16 |
| Gelatin | 1.0 |
| Layer 5 (first intermediate layer) | |
| Gelatin | 1.0 |
| Anti-color-mixing agent HQ-1 | 0.08 |
| Layer 6 (first green-sensitive layer) | |
| Magenta coupler M-A | 0.14 |
| High-boiling sovent TCP | 0.15 |
| AgBrI emulsion spectrally sensitized by green-sensitizing dye S-3 (AgI 3.0 mole %, average grain diameter 0.4 μm) | 0.15 |
| Gelatin | 1.0 |
| Layer 7 (second green-sensitive layer) | |
| Magenta coupler M-A | 0.14 |
| High-boiling solvent TCP | 0.15 |
| AgBrI emulsion spectrally sensitized by green-sensitizing dye S-3 (AgI 3.0 mole %, average grain diameter 0.7 μm) | 0.15 |
| Gelatin | 1.0 |

-continued

| | |
|---|---|
| Layer 8 (second intermediate layer) | |
| Yellow colloidal silver | 0.15 |
| Anti-color-mixing agent HQ-1 | 0.08 |
| Gelatin | 1.0 |
| Layer 9 (first blue-sensitive layer) | |
| Yellow coupler Y-3 | 0.40 |
| High-boiling solvent DBP | 0.10 |
| AgBrI emulsion spectrally sensitized by blue-sensitizing dye S-4 (AgI 3.0 mole %, average grain diameter 0.4 μm) | 0.15 |
| Gelatin | 0.70 |
| Layer 10 (second blue-sensitive layer) | |
| Yellow coupler Y-3 | 0.80 |
| High-boiling solvent TCP | 0.20 |
| AgBrI emulsion spectrally sensitized by blue-sensitizing dye S-4 (AgI 3.0 mole %, average grain diameter 0.8 μm) | 0.20 |
| Gelatin | 1.3 |

-continued

| | |
|---|---|
| Layer 11 (ultraviolet absorbing layer) | |
| Ultraviolet absorbing agent UV-1 | 0.2 |
| Ultraviolet absorbing agent UV-2 | 0.2 |
| Ultraviolet absorbing agent UV-3 | 0.2 |
| Ultraviolet absorbing agent UV-4 | 0.2 |
| Gelatin | 2.0 |
| Layer 12 (protective layer) | |
| Gelatin | 1.0 |

In addition to the above components, each layer also contains a surface active agent, a hardener and an anti-irradiation dye.

DBP: Dibutyl phthalate

TCP: Tricresyl phosphate

The C-1, C-2, HQ-1, M-A, UV-1 and UV-2 are the same as those used in Example 1.

Y-3

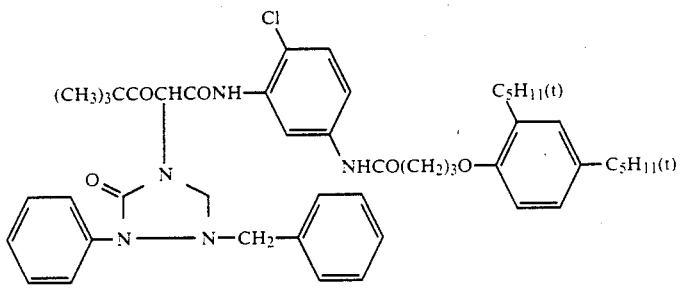

S-1

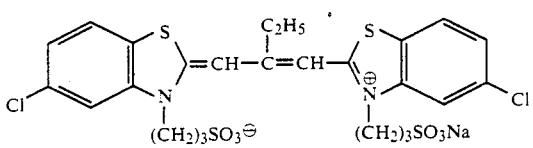

S-2

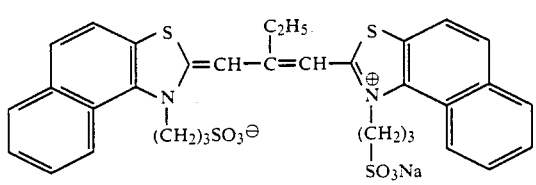

S-3

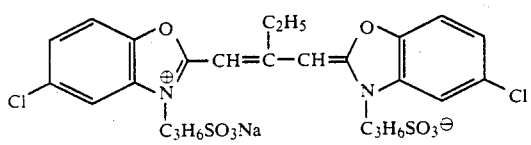

S-4

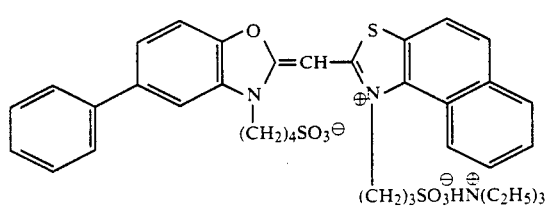

UV-3

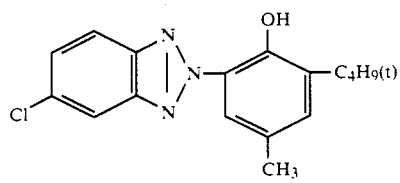

-continued

UV-4

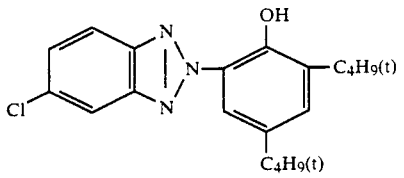

Also, other samples were prepared in the same manner as in Sample 22 except that the combination of the magenta coupler and antifading agents, compound I in 1.5 mole per mole of the coupler and compound II in 0.5 mole per mole of the coupler, in the layers 6 and 7 was changed as given in Table 3.

Each sample was subjected to a magenta exposure through an optical wedge with a color filter CC-90M, produced by Eastman Kodak Company, and then processed in accordance with the following steps:

| | |
|---|---|
| First developing (monochromatic development) | 1 min. 15 sec. (38° C.) |
| Washing | 1 min. 30 sec. |
| Exposing to light at 100 luces or more | 1 sec. or more |
| Second developing (color development) | 2 min. 15 sec. (38° C.) |
| Washing | 45 sec. |
| Bleach-fix | 2 min. (38° C.) |
| Washing | 2 min. 15 sec. |

| First developer | |
|---|---|
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 ml |
| Potassium carbonate | 14 g |
| Sodium hydrogencarbonate | 12 g |
| 1-Phenyl-4-methyl-4-hydroxymethyl-3-pyrazolidone | 1.5 g |
| Sodium hydroquinone-monosulfonate | 23.3 g |
| Water to make 1 liter (pH 9.65) | |
| **Color developer** | |
| Benzyl alcohol | 14.6 ml |
| Ethylene glycol | 12.6 ml |
| Anhydrous potassium carbonate | 26 g |
| Potassium hydroxide | 1.4 g |
| Sodium sulfite | 1.6 g |
| 3,6-Dithiaoctane-1,8-diol | 0.24 g |
| Hydroxylamine sulfate | 2.6 g |
| 4-N-ethyl-N-β-(methanesulfonamidoethyl)-2-methyl-p-phenylenediamine-sesquisulfate | 5.0 g |
| Water to make 1 liter. | |

-continued

| Bleach-fix bath | |
|---|---|
| Ferric-ammonium ethylenediaminetetra-acetate. 1.56 mole solution | 115 ml |
| Sodium metabisulfite | 15.4 g |
| Ammonium thiosulfate (58%) | 126 ml |
| 1,2,4-triazole-3-thiol | 0.4 g |
| Water to make 1 liter (pH = 6.5) | |

The light fastness and gradation of the magenta dye image of each processed sample were measured in the same manner as in Example 1.

The results are shown in Table 3.

TABLE 3

| Sample No. | Magenta coupler | Compound I | Compound II | Fastness Fading rate (%) | Gradation γ |
|---|---|---|---|---|---|
| 22 (comp.) | M-A | — | — | −57 | 1.53 |
| 23 (comp.) | M-A | I-31 | — | −22 | 1.36 |
| 24 (comp.) | M-A | — | II-3 | −24 | 1.45 |
| 25 (inv.) | M-A | I-31 | II-3 | −13 | 1.57 |
| 26 (inv.) | M-A | I-13 | II-3 | −11 | 1.55 |
| 27 (inv.) | M-A | I-15 | II-3 | −10 | 1.55 |
| 28 (comp.) | M-B | — | — | −55 | 1.57 |
| 29 (comp.) | M-B | I-31 | — | −22 | 1.38 |
| 30 (comp.) | M-B | — | II-3 | −25 | 1.44 |
| 31 (inv.) | M-B | I-31 | II-3 | −13 | 1.58 |
| 32 (inv.) | M-B | I-13 | II-3 | −10 | 1.59 |
| 33 (inv.) | M-B | I-15 | II-3 | −10 | 1.60 |
| 34 (comp.) | M-C | — | — | −87 | 1.62 |
| 35 (comp.) | M-C | I-31 | — | −38 | 1.45 |
| 36 (comp.) | M-C | — | II-3 | −46 | 1.51 |
| 37 (inv.) | M-C | I-31 | II-3 | −24 | 1.65 |
| 38 (inv.) | M-C | I-13 | II-3 | −17 | 1.67 |
| 39 (inv.) | M-C | I-15 | II-3 | −15 | 1.66 |
| 40 (comp.) | M-C | ST-1 | — | −92 | 0.45 |
| 41 (comp.) | M-C | ST-1 | II-3 | −83 | 0.51 |

The ST-1 and M-A used in above are the same as those in Example 1.

The coated weight of silver of the layers 6 and 7 of each of the samples 32 through 39 is 0.075 g/m$^2$.

M-B

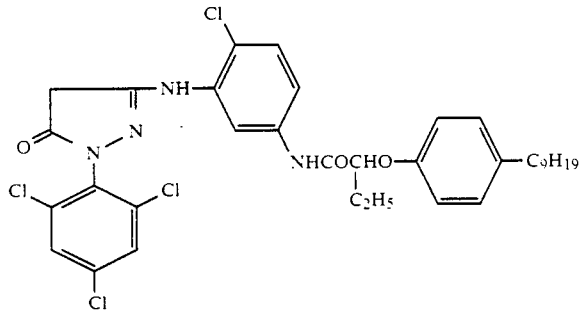

-continued

M-C

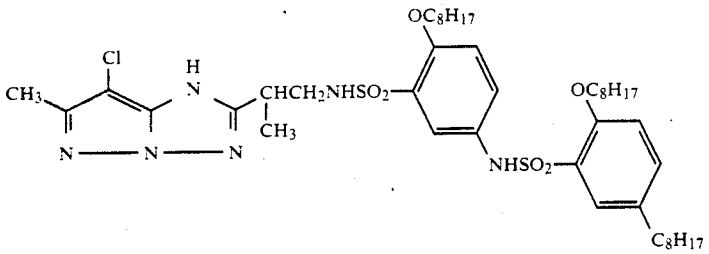

As is apparent from Table 3, a dye image having a gradation little deteriorated and an excellent light resistance was obtained only when the combination of the antifading agents of this invention was used.

EXAMPLE 3

Fifty grams of a magenta coupler M-A were dissolved in 200 ml of a mixture of 80 ml of a high-boiling organic solvent DNP and 200 ml of ethyl acetate, and the solution was added to an aqueous 5% gelatin solution containing a dispersion assistant, and dispersed by a homogenizer. The quantity of the dispersion was made 1,500 ml, and then maintained at 35° C. The dispersion was added to 1,000 ml of an aqueous 3% gelatin solution, and to the mixture were further added 400 g of a green-sensitive silver chlorobromide emulsion containing silver bromide 80 mole%, silver 30 g, whereby a coating liquid for Layer 3 was prepared.

Coating liquids for the other layers were also prepared likewise. On a polyethylene-laminated paper support (the emulsion layer side polyethylene contains titanium oxide and a blue-tinting agent), which was subjected to corona discharge treatment, were coated the following layers in order from the support side, whereby a color light-sensitive material sample 42 was prepared.

Layer 1: Blue-sensitive emulsion layer

Coated so that the coating weights of the components thereof are as follows yellow coupler Y-4...8 mg/dm$^2$, antithereof fading agent ST-1...3 mg/dm$^2$, blue-sensitive silver chlorobromide emulsion containing silver chloride 20 mole%, silver bromide 80 mole% ...3 mg/dm$^2$ in silver equivalent, high-boiling organic solvent DNP...3 mg/dm$^2$, and gelatin...16 mg/dm$^2$.

Layer 2: Intermediate layer

Coated so that the coating weights of the components thereof are as follows: hydroquinone derivative HQ-1...0.45 mg/dm$^2$, diaminostilbene-type brightening agent...1 mg/dm$^2$ and gelatin...4 mg/dm$^2$.

Layer 3: Green-sensitive emulsion layer

Coated so that the coating weights of the components thereof are as follows: magenta coupler M-A...4 mg/dm$^2$, green-sensitive silver chlorobromide emulsion containing silver chloride 20 mole% and silver bromide 80 mole% ...2 mg/dm$^2$ in silver equivalent, high-boiling organic solvent DIDP..4 mg/dm$^2$ and gelatin...16 mg/dm$^2$.

Layer 4: Intermediate layer

Coated so that the coating weights of the components thereof are as follows: ultraviolet absorbing agent UV-1...3 mg/dm$^2$, UV-2...3mg/dm$^2$, DNP...4 mg/dm$^2$, hydroquinone derivative HQ-2...0.45 mg/dm$^2$, gelatin...14 mg/dm$^2$, and an oil-soluble blue-tinting agent...a slight amount.

Layer 5 Red-sensitive emulsion layer

Coated so that the coating weights of the components thereof are as follows: cyan coupler C-1...2 mg/dm$^2$, cyan coupler C-2...2 mg/dm$^2$, antifading agent ST-1...2 mg/dm$^2$, DOP...4 mg/dm$^2$, red-sensitive silver chlorobromide emulsion containing silver chloride 20 mole% and silver bromide 80 mole%...3 mg/dm$^2$ in silver equivalent, and gelatin...14 mg/dm$^2$.

Layer 6: Intermediate layer

Coated so that the coating weights of the components thereof are as follows: ultraviolet absorbing agent UV-5...4 mg/dm$^2$, HQ-1...0.2 mg/m$^2$, polyvinylpyrolidone...1 mg/dm$^2$, DNP...2 mg/dm$^2$ and gelatin...6 mg/dm$^2$.

Layer 7: Protective layer

Coated so that the coating weight of gelatin is 9 mg/dm$^2$.

Also, other samples were prepared in the same manner as in the sample 4 except that the antifading agents (compounds I and II) and the high-boiling organic solvent of Layer 3 were changed as shown in Table 4.

The compounds used in preparing the samples

M-A, ST-1, DNP, HQ-1, DIDP, UV-1, UV-2, C-1, C-2 and DOP, which are the same as those used in Example 1.

HQ-2

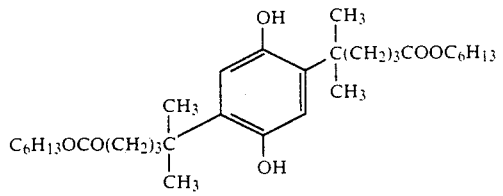

-continued

UV-5

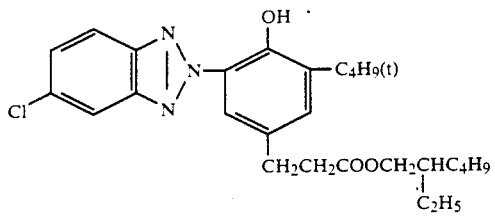

Y-4

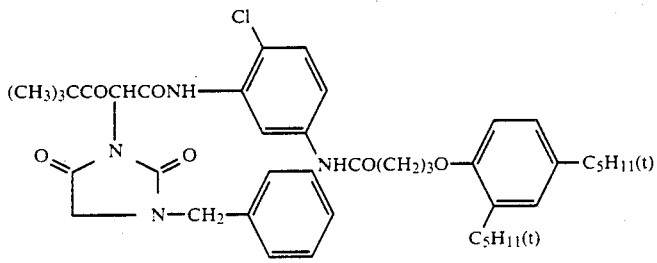

Each sample was exposed through an optical wedge to a green light by a Sensitometer KS-7, manufactured by KONICA Corporation, and then processed in accordance with the following steps.

| Processing steps | Temperature | Time |
|---|---|---|
| Color developing | 32.8° C. | 3 min. 30 sec. |
| Bleach-fix | 32.8° C. | 1 min. 30 sec. |
| Stabilizing | 32.8° C. | 3 min. 30 sec. |

Color developer

| | |
|---|---|
| N-ethyl-N-β-methanesulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (average polymerization degree 400) | 3.0 ml |

-continued

| | |
|---|---|
| Water to make 1 liter. Adjust the pH to 10.0. with sodium hydroxide. | |
| Bleach-fix bath | |
| Ferric-sodium ethylenediaminetetraacetate | 60.0 g |
| Sodium thiosulfate | 100.0 g |
| Sodium hydrogensulfite | 20.0 g |
| Sodium metabisulfite | 5.0 g |
| Water to make 1 liter. | |
| Adjust the pH to 7.0 with sulfuric acid. | |
| Stabilizer bath | |
| The same as Example 1. | |

The above processing was carried out in an automatic processor with a stabilizer bath of a multistage counter flow system.

The obtained magenta dye image of each sample was measured with respect to the fastness to light and gradation in the same manner as in Example 1.

The results are shown in Table 4.

TABLE 4

| Sample No. | Magenta coupler | Compound I | Compound II | High-boiling solvent | Fastness Fading rate (%) | Gradation γ |
|---|---|---|---|---|---|---|
| 42 (comp.) | M-A | — | — | DNP | −55 | 3.19 |
| 43 (comp.) | M-A | I-31 | — | DNP | −24 | 3.05 |
| 44 (comp.) | M-A | — | II-3 | DNP | −26 | 3.13 |
| 45 (inv.) | M-A | I-31 | II-3 | DNP | −16 | 3.21 |
| 46 (inv.) | M-A | I-13 | II-3 | DNP | −11 | 3.22 |
| 47 (inv.) | M-A | I-13 | II-3 | DIDP | −11 | 3.24 |
| 48 (inv.) | M-A | I-13 | II-3 | DOP | −12 | 3.23 |
| 49 (inv.) | M-A | I-13 | II-3 | DBP | −14 | 3.20 |
| 50 (comp.) | M-D | — | — | DNP | −63 | 3.20 |
| 51 (comp.) | M-D | I-31 | — | DNP | −29 | 3.01 |
| 52 (comp.) | M-D | — | II-3 | DNP | −30 | 3.10 |
| 53 (inv.) | M-D | I-31 | II-3 | DNP | −19 | 3.21 |
| 54 (inv.) | M-D | I-13 | II-3 | DNP | −13 | 3.23 |
| 55 (inv.) | M-D | I-13 | II-3 | DIDP | −13 | 3.24 |
| 56 (inv.) | M-D | I-13 | II-3 | DOP | −14 | 3.23 |
| 57 (inv.) | M-D | I-13 | II-3 | TOP | −15 | 3.20 |
| 58 (inv.) | M-E | I-13 | II-3 | TOP | −11 | 3.13 |

M-D

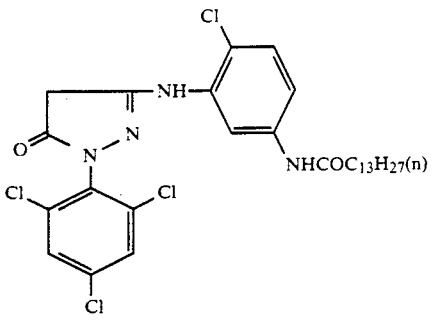

(M-E

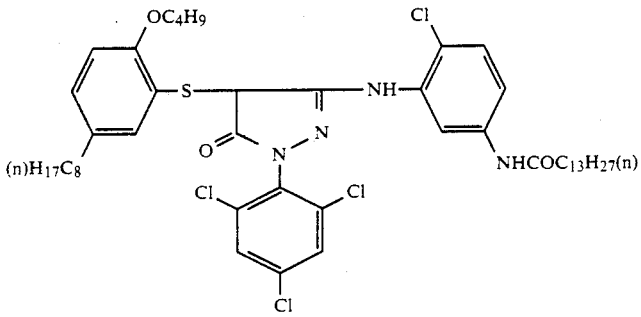

DBP: Dibutyl phthalate
TOP: Trioctyl phosphate

The coating weight of the silver of the Layer 3 of Sample 56 was 1 mg/dm$^2$.

As is apparent from Table 4, a dye image having a well improved light resistance and a gradation little deteriorated is obtained only when the combination of the antifading agents of this invention is used.

EXAMPLE 4

Samples were prepared in the same manner as the sample 1 of Example 1 except that the magenta coupler of the green-sensitive emulsion layer in Example 1 was replaced by the following magenta coupler M-F, the coating weight of silver of the green-sensitive emulsion layer was 0.14 g/dm$^2$, and the combination of the antifading agents (compounds I and II) was changed as shown in Table 5. And these samples' light resistance and gradation were evaluated.

The results are shown in Table 5.

TABLE 5

| Sample No. | Compound | Compound | Light fastness Fading rate (%) | Gradation $\gamma$ |
|---|---|---|---|---|
| 59 (comp.) | — | — | −85 | 3.14 |
| 60 (comp.) | I-31 | — | −35 | 3.03 |
| 61 (comp.) | — | II-3 | −43 | 3.10 |
| 62 (inv.) | I-31 | II-3 | −21 | 3.15 |
| 63 (inv.) | I-13 | II-3 | −14 | 3.16 |
| 64 (inv.) | I-15 | II-3 | −14 | 3.15 |
| 65 (comp.) | ST-1 | — | −95 | 2.21 |
| 66 (comp.) | ST-1 | II-3 | −91 | 2.27 |

M-F

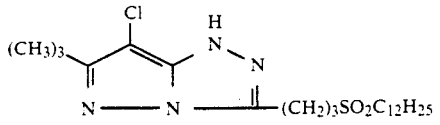

Thus, according to the invention, a high-sensitivity and high-gradation silver halide light-sensitive photographic material capable of forming a dye image excellent in the color reproduction as well as in the light fastness can be obtained.

What is claimed is:

1. A silver halide photographic light-sensitive material comprising a support having thereon a silver halide emulsion layer containing a dye-forming coupler, a compound represented by the following Formula I, and a compound represented by the following Formula II:

(I)

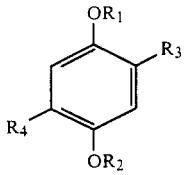

(II)

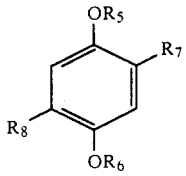

wherein $R_1$ and $R_2$ each represents a straight or branched chain alkyl group having 1 to 4 carbon atoms or a straight or branched chain alkenyl group having 1 to 4 carbon atoms; $R_5$ and $R_8$ each represents a straight or branched chain alkyl group having 5 to 18 carbon atoms or a straight or branched chain alkenyl group having 5 to 18 carbon atoms; and $R_3$, $R_4$, $R_7$ and $R_8$ each represents a straight or branched chain alkyl group having 4 to 8 carbon atoms.

2. The material of claim 1, wherein said compound represented by Formula I is contained in said silver halide emulsion layer in an amount of from 0.05 mole to 3 mole per mole of said coupler.

3. The material of claim 2, wherein said compound represented by Formula I is contained in said silver halide emulsion layer in an amount of from 0.5 mole to 2 mole per mole of said coupler.

4. The material of claim 1, wherein said compound represented by Formula II is contained in said silver halide emulsion layer in an amount of from 0.05 mole to 2 mole per mole of said coupler.

5. The material of claim 4, wherein said compound represented by Formula II is contained in said silver halide emulsion layer in an amount of from 0.05 mole to 0.5 mole per mole of said coupler.

6. The material of claim 1, wherein said coupler is represented by the following formula M:

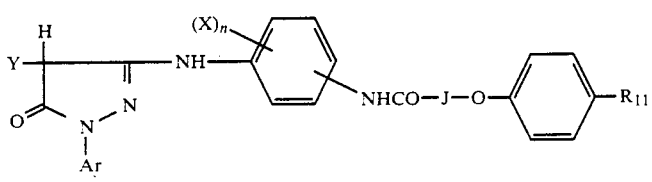

(M)

wherein Ar is an aryl group, Y is a hydrogen atom or a group capable of being split off upon reaction with the oxidation product of a color developing agent; X is a halogen atom, an alkoxy group, an alkyl group; $R_{11}$ is a straight or branched alkyl group having 1 to 20 carbon atoms; J is a straight or branched chain alkylene group; n is an integer of from zero to 4 provided that the groups represented by X are allowed to be the same with or different from each other when n is 2 or more.

7. The material of claim 1, wherein said coupler being in the state where it is dissolved in a high-boiling organic solvent is contained in said emulsion layer.

8. The material of claim 7, wherein said high-boiling organic solvent has a dielectric constant of not more than 6.0 at 30° C.

9. The material of claim 8, wherein said high-boiling organic solvent has a dielectric constant of from 1.9 to 6.0 at 30° C. and a vapor pressure of not more than 0.5 mmHg at 100° C.

* * * * *